US008926382B2

(12) United States Patent
Van Der Kam et al.

(10) Patent No.: US 8,926,382 B2
(45) Date of Patent: Jan. 6, 2015

(54) MOUNTING METHOD OF THRUSTER

(75) Inventors: Aad Van Der Kam, Drunen (NL); Arnoud De Kruijf, Haaren (NL)

(73) Assignee: Wartsila Finland Oy (FI)

( * ) Notice: Subject to any disclaimer, the term of this patent is extended or adjusted under 35 U.S.C. 154(b) by 0 days.

(21) Appl. No.: 13/259,206

(22) PCT Filed: Apr. 16, 2010

(86) PCT No.: PCT/EP2010/055065

§ 371 (c)(1),
(2), (4) Date: Oct. 10, 2011

(87) PCT Pub. No.: WO2011/127987

PCT Pub. Date: Oct. 20, 2011

(65) Prior Publication Data

US 2013/0036962 A1 Feb. 14, 2013

(51) Int. Cl.

| | |
|---|---|
| ***B63H 5/125*** | (2006.01) |
| ***B63H 21/30*** | (2006.01) |
| ***B63B 17/00*** | (2006.01) |
| ***B63H 21/17*** | (2006.01) |

(52) U.S. Cl.

CPC ..... *B63H 21/30* (2013.01); *B63B 17/0018* (2013.01); *B63H 21/17* (2013.01)

USPC ..... 440/54

(58) Field of Classification Search

USPC ..... 440/54

IPC ..... B63H 5/125

See application file for complete search history.

(56) References Cited

U.S. PATENT DOCUMENTS

| | | | | |
|---|---|---|---|---|
| 4,036,163 | A | 7/1977 | Pehrsson | |
| 4,075,971 | A * | 2/1978 | Reginensi et al. | 440/54 |
| 6,361,386 | B1 | 3/2002 | Savikurki et al. | |
| 6,439,936 | B1 | 8/2002 | Dreith et al. | |
| 2001/0029133 | A1 | 10/2001 | Breems | |

FOREIGN PATENT DOCUMENTS

| | | |
|---|---|---|
| FR | 2560147 | 8/1985 |
| WO | WO2010136012 | 12/2010 |

* cited by examiner

*Primary Examiner* — Stephen Avila
(74) *Attorney, Agent, or Firm* — Standley Law Group LLP

(57) ABSTRACT

A method for maintenance of a unit which is arranged in a watertight hoisting chamber and closes an opening in a vessel hull is described. The method includes clamping of the unit in its mounted position by a clamping member so that fixing member of the unit can be removed while the unit is held clamped in position. After the hoisting chamber is flooded to a desired level, the clamping of the unit can be completely released and no unintentional movement of the unit will occur. Guide member may be provided together with the apparatus and an automatic design of the clamping member can also be provided. Preferably, the clamping member are hydraulic cylinders which press the unit into its mounted position.

7 Claims, 4 Drawing Sheets

MOUNTING METHOD OF THRUSTER

TECHNICAL FIELD

The invention relates to a method for maintenance of a unit, which unit is arranged in a vessel hull, which unit closes a vessel hull and which unit is adapted to extend into the water below the vessel.

Further, the invention relates to an apparatus for maintenance of a unit, which unit closes an opening in the vessel hull and which unit is adapted to extend into the water below the vessel hull.

BACKGROUND OF THE ART

Document WO 97/27102 describes a method and apparatus for removing a propeller assembly from an opening of a swimming vessel, wherein the propeller assembly is designed to close an opening in the vessel hull when the propeller assembly is in its mounted position. According to this prior art, a watertight hoisting chamber is provided around the propeller assembly and inside that hoisting chamber a drive shaft is provided, which leads to a drive motor positioned in the vessel and outside of the hoisting chamber. When the known propeller assembly is to be removed, the drive shaft is removed first, then its passage through the hoisting chamber wall is closed in a watertight manner, after that the propeller assembly is connected to hoisting means and then a flange of the propeller assembly is loosened. Then, the propeller assembly can be lifted from the hoisting chamber. The propeller assembly is also known as thruster.

The method according to the prior art requires assembly/disassembly work which has to be carried out under water.

SUMMARY

Further, large vessels can have a draught which is up to 20 meters under water surface level. In this case, considerable forces act to push the thruster upwards and inside the vessel due to the difference in pressures between the water pressure outside and the air pressure inside the vessel. With large thrusters, the forces pushing up the thrusters which are not compensated by thruster weight may reach up to 2.000 kN. When the fixing screws of the flange are removed, the propeller assembly or thruster is lifted by these forces in uncontrolled manner. Having such a heavy mass which moves in uncontrolled manner is dangerous. Further, loosening of the fixing of the flange while under these forces is difficult.

In view of the above prior art, it is the object of the invention to suggest an improved method and apparatus for maintenance of a unit which passes through and closes an opening in the vessel hull while the vessel is swimming.

With regard to the method, this object is solved with a method according to claim 1.

In particular, the invention provides a method for maintenance of a unit arranged in the watertight hoisting chamber and closing an opening in a vessel hull, wherein the unit is adapted to extend into the water below the swimming vessel. The method according to the invention comprises the steps of clamping the unit in its mounted position by clamping means, releasing fixing means which fix the unit into its mounted position while holding the unit clamped in its position and at least partly flooding the hoisting chamber, then releasing the clamping of the unit and hoisting the unit away from its mounted position.

According to the invention, a clamping means is used to clamp the unit in its mounted position before the fixing means which are normally used for mounting the unit into its position, are removed. In this way, the opening can be held closed and the unit is held in position, so that the work for releasing the fixing means can be carried out while it is still dry in the hoisting chamber. After the fixings are removed, the hoisting chamber is at least partly flooded either by provision of an extra valve for flooding the chamber or by a controlled release of the clamping of the unit. When the clamping is released, the water in the at least partly flooded hoisting chamber puts some pressure on the unit from the vessel inside, so that the pressure differences at the unit between inside and outside the vessel are reduced. Therefore, the forces pushing up the unit can be reduced.

The method for maintenance of a unit according to the invention may further comprise the steps of lowering the unit into its mounted position inside the hoisting chamber, clamping the unit in its mounted position, thereby closing the opening in the vessel hull, at least partly removing the water from the hoisting chamber and then applying the fixing means for fixing the unit in its mounted position. After that, clamping may be released.

With the above advantageous method, the unit is set in its mounted position and fixed there by the fixing means. Clamping of the unit may be provided, in order to establish a watertight sealing of the bottom of the hoisting chamber by setting the unit into and clamping it in its mounted position. After the water has been removed from the hoisting chamber, fixing work for applying the fixing means of the unit can be carried out in a dry space or environment.

Thus, as has been described before, dismounting or releasing of the fixing means and application of the fixing means can both be carried out in a dry environment, so that no underwater-work is required for this.

The method may comprise the step of placing a hoisting chamber assembly with an open upper end over the unit, so as to arrange the unit therein. The chamber assembly may be fixed to the vessel hull in a watertight manner with respect to the hull, wherein the height of the hoisting chamber and the water level on the outside of the hull are set such that the open upper end of the chamber extends over the water level. This prevents water from entering the vessel hull when the hoisting chamber is flooded. It is noted that a mobile hoisting chamber assembly may be used, which is to be mounted inside the vessel hull when needed, or it may be a chamber which is right from the beginning built into the vessel. In the latter case, fixing of the hoisting chamber assembly to the vessel hull is preferably made by welding. The hoisting chamber may form a part of the vessel hull structure.

The step of flooding the hoisting chamber may be carried out such that a gradual release of the clamping means is allowed, until water enters through the opening of the hull into the hoisting chamber. Water can be filled into the hoisting chamber up to even level with the outside water level, when the opening allows intrusion of water.

In the method according to the invention it may be provided that the clamping is done using hydraulic forces for clamping.

Preferably, a hoist means is fixed to the unit before the hoisting chamber is flooded. This has the advantage that also this work can be carried out in a dry environment. Also, when the unit is held by the clamping means, the fixing means can be removed. And when the unit is held by the clamping means, the hoist means may be fixed to the unit after the fixing means have been removed. Accordingly, the available space for working at the fixing means is larger.

The invention further provides an apparatus for maintenance of a unit closing an opening in the vessel hull, wherein the unit is adapted to extend into the water below the vessel.

This apparatus comprises a hoisting chamber which is adapted to be fixed to the hull, so as to form a watertight seal, a hoist means for hoisting the unit away from and into its mounted position and a clamping means adapted to clamp the unit into its mounted position.

Preferably, the apparatus may have a clamping means fixed to the hull and comprising at least one hydraulic cylinder as the clamping means. Hydraulic cylinders are strong, easy to control and are a very reliable technology. Therefore, providing the clamping means already in situ at the vessel hull reduces effort for setting or mounting an apparatus in place when maintenance of the unit is required.

Preferably, the clamping means has at least one guide surface and at least one clamp or clamp member which is adapted to cooperate with at least one clamping pad provided on the unit. The guide surface is adapted to guide the clamp member automatically to the clamping pad when the at least one hydraulic cylinder expands. This cooperation of the clamp member and clamp pad can be initiated by controlling expansion movement of the hydraulic cylinder.

In particular, when the unit has been lowered into its mounted position by use of the hoist means, operation of the hydraulic cylinders drives the clamp member guided by the guide surface to the clamp pad of the unit. In this way, the unit can be clamped into its mounted position which means that the opening in the vessel hull is closed by the unit. Then, water can be removed from the hoisting chamber, so that fixing means may then be applied in dry environment. In the same way, when removing the unit, clamping means are driven into their clamping position to hold the unit securely in its mounted position. Then, after the fixing means have been removed, the hydraulic cylinders of the clamping means may be drained or pulled back, so that the unit is pushed slightly upwards until water enters the hoisting chamber. In this way, with the unit being stably held in a predictable position, the hoisting chamber can be flooded. When the water level in the hoisting chamber is sufficient, the clamping means may be released by fully retracting the hydraulic cylinders. After that, the unit can be lifted out from the hoisting chamber.

Preferably, the clamping means, especially the cylinders, are fixed to the hoisting chamber which itself is fixed to the vessel hull.

Preferably, the clamping means comprises eight hydraulic cylinders arranged at equal angles inside the hoisting chamber and around the opening in the hull when the hoisting chamber is mounted. The hoisting chamber may be mounted to the hull by welding, that is, during vessels building phase. However, it is also possible to have a mobile hoisting chamber which can be fixed to suitable portions provided in the vessel hull in order to form a watertight seal and a sufficiently strong connection.

It is also preferred that the hoisting chamber wall has at least one guide rail which extends in the height direction of the chamber. The unit cooperates with a guide rail of rails when the unit is lifted and lowered. In particular, when the unit is lowered, it will automatically be guided to its mounted position by the guide rails and can then be clamped into this position by the clamping means which also have guide surfaces for automatically guiding the clamp or clamp member to the clamp pad.

BRIEF DESCRIPTION OF THE DRAWINGS

Also preferably, the hoist chamber has a lid or cover at its upper end for watertightly closing that chamber. The cover is an additional safety feature recommendable in rough sea when the water level outside the ship climbs and falls rapidly, and the water in the hoisting chamber does as well when the unit is removed and does not close the opening. The invention will now be described in more detail by way of an embodiment, using the schematic drawing figures for explanation. In the drawings.

DETAILED DESCRIPTION

Figure 1:
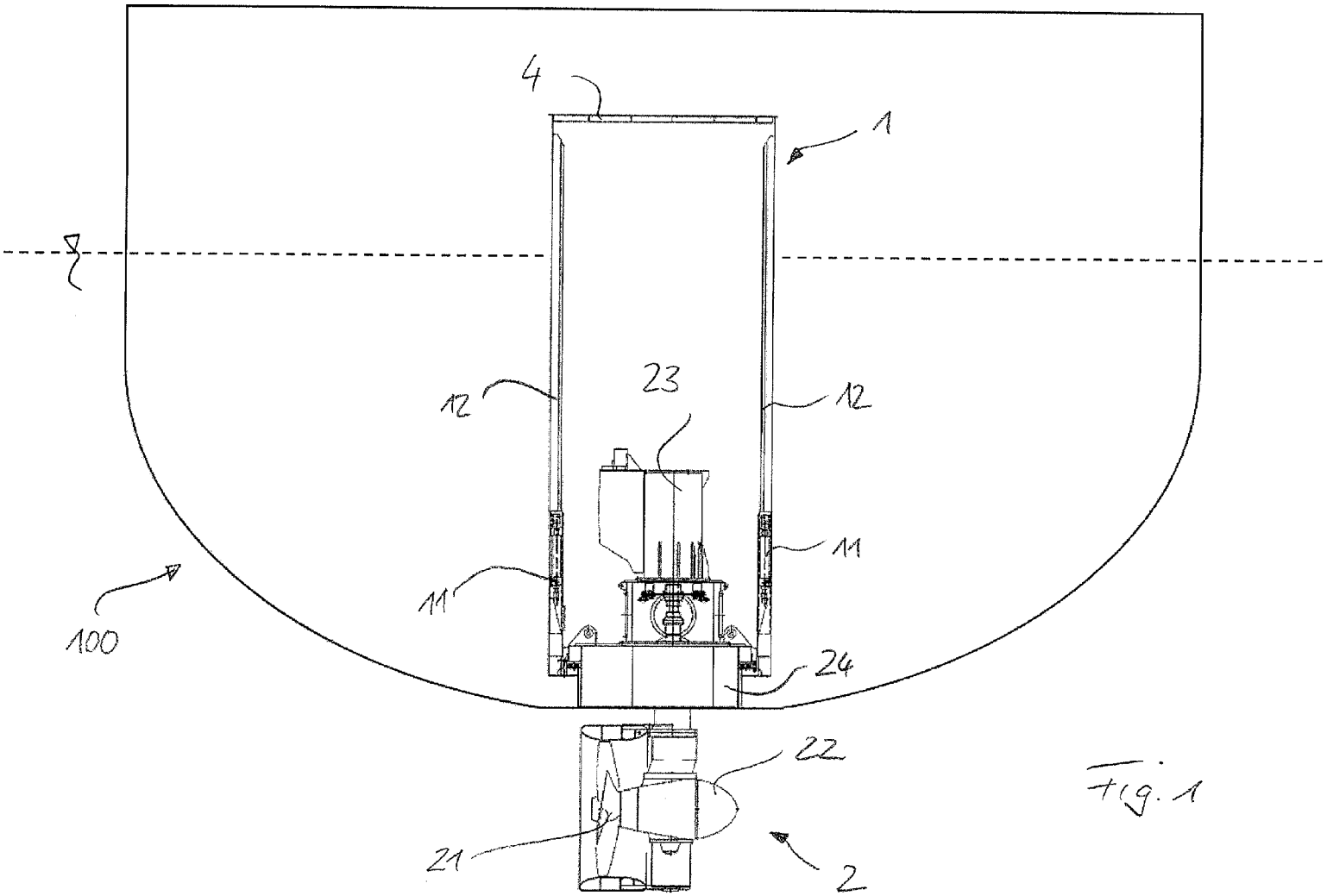
FIG. 1 shows a section of a vessel with a hoisting chamber and a mounted unit.

FIG. 1 shows a vessel hull 100 which swims in water as is indicated with the broken line in FIG. 1. Inside the vessel, there is provided a hoisting chamber 1 which is a fixed construction fixedly mounted to the vessel 100.

Inside the hoisting chamber 1 there is a unit 2 which extends through the bottom of the vessel hull 100 to the outside. This is the unit which requires maintenance. Here, the unit is a so-called thruster 2. The thruster 2 has a propeller 21, a gear housing 22, a flange portion 24 and an electric motor 23 for driving the propeller 21. Another term for the flange portion 24 is mounting can; hereinafter the term flange portion is used for that part. Of this thruster 2, the propeller 21 and the gear housing 22 are the elements immersed in water, while the flange portion 24 closes the opening in the vessel hull 100 when the unit is mounted. The propeller 21 and the gear housing 22 may be rotated around an axis substantially perpendicular to the rotational axis of the propeller 21. This kind of thruster is often used in connection with large vessels for position control. The flange portion 24 may also be developed and contain a gear box and drive means for rotating the thruster around its substantially vertical axis.

FIG. 1 further shows that hoisting chamber 1 has guide rails 12 at its wall extending along the chamber in its height direction; here two guide rails 12 are shown. Also, clamping means 11 are shown which will be discussed in more detail under reference being made to other drawing figures. It is noted that only a pair of clamping means 11 is shown in FIG. 1 although typically up to eight clamping means are provided which are arranged on a circle at equal angular intervals around the flange portion 24.

Further, FIG. 1 shows a cover 4 of the hoisting chamber, which preferably watertightly closes the hoisting chamber at its upper end. One of the functions of this cover is of course to avoid that someone may fall into this chamber (in the shown example vessel's draught is about 18 meters) and, on the other hand, the cover is additional protection against immersion of water into the vessel when the opening in the vessel bottom is not tightly closed for whatever reason.

Figure 2:
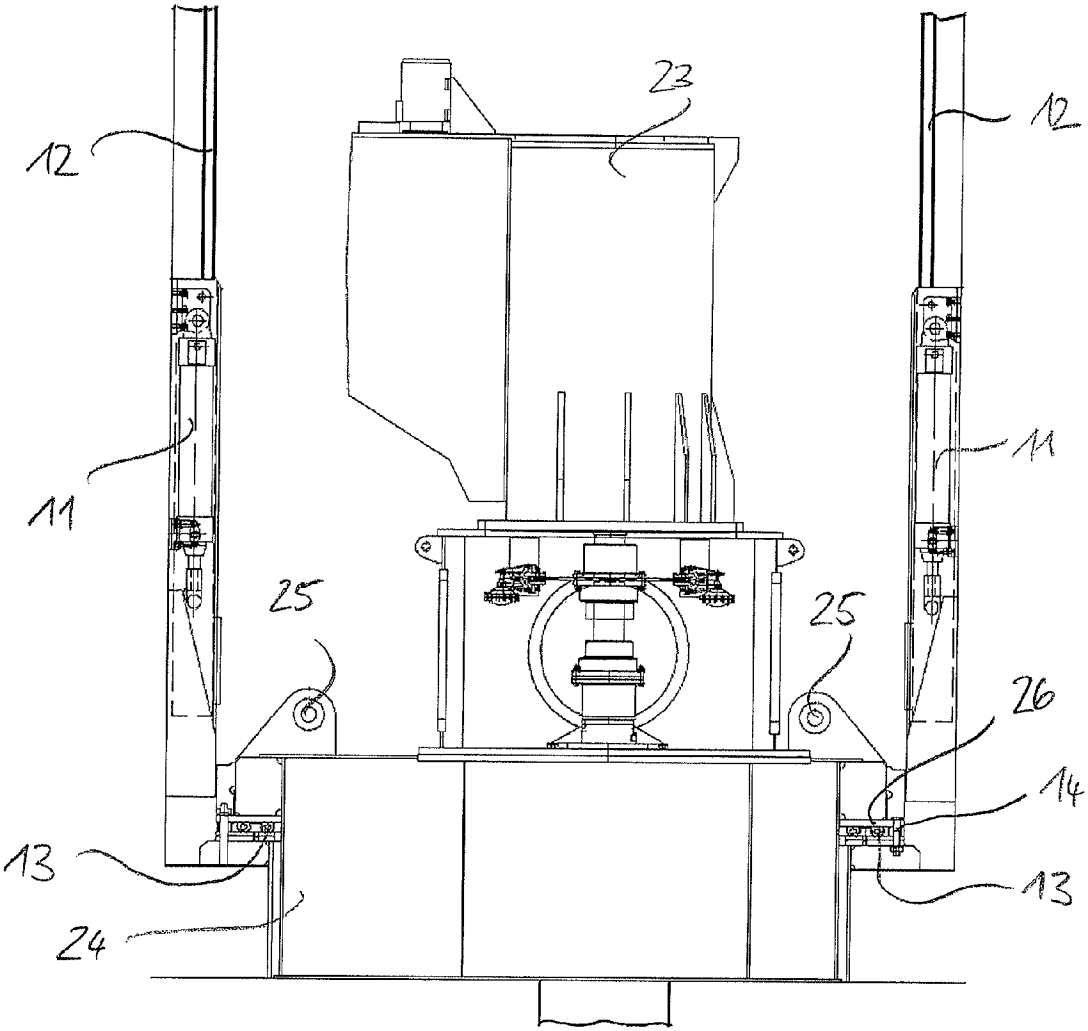
FIG. 2 shows an enlarged schematic view of a portion of FIG. 1 where a part of the hoisting chamber and a part of the unit is shown.

FIG. 2 shows an enlarged view of the arrangement of the thruster 2 at a portion close to the flange portion 24 of the thruster. The flange portion 24 of the thruster further comprises hoisting eyes 25 and a flange plate portion 26, which cooperates with seals 13 for watertightly closing the opening in the vessel hull 100. Screws 14 form the fixing means and a number of screws is provided along the flange plate portion 26 in a circle around the unit 2. On the left and right of FIG. 2 a part of the hoisting chamber wall is shown, which hoisting chamber wall carries two guide rails 12 which are indicated here by a double line. Although not shown, unit 2, in particular the flange portion 24 thereof, has guide means which cooperate with the guide rails, when the unit is moved inside the hoisting chamber. Although two guide rails 12 are shown in FIG. 2, any suitable number of guide rails can be provided. Also, clamping means 11 are shown fixed to the hoisting chamber wall. Functional cooperation of the clamping means 11 with the flange portion 24 of the unit 2 will be described by reference being made to FIG. 3.

Further, FIG. 2 shows a huge electric motor 23 which is fixed to a gear box having a coupling so as to be in drive connection with a propeller (not shown in FIG. 2) of the unit 2. Of course, other motors may be used.

Figure 3:
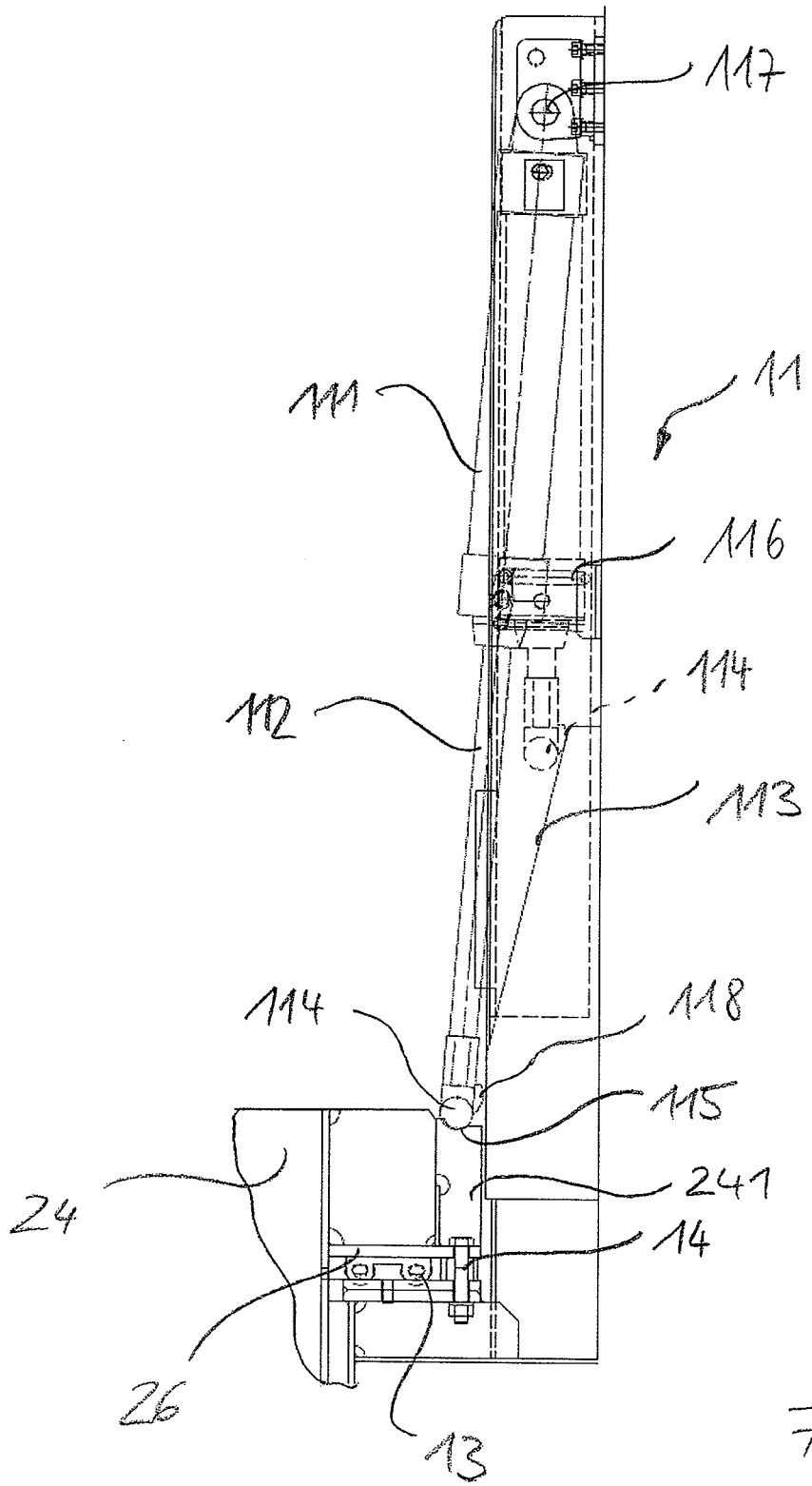
FIG. 3 shows a detail of a clamping means cooperating with the unit.

Turning now to FIG. 3, a detail of a clamping means 11 as shown of the right-hand side of FIG. 2 is shown in more detail in FIG. 3. The clamping means 11 has a hydraulic cylinder 111 which has a cylinder rod 112. By controlling flow of hydraulic fluid to and from the cylinder 111, movement of the rod 112 can be controlled. At the end of the rod 112 there is shown a clamp 114, which is adapted to cooperate with a clamping pad 115 provided on the flange portion 24 of the unit 2. Also, FIG. 3 shows the fixing screws 14 serving as the fixing means and a seal 13 for watertightly sealing the connection between the unit 2 and the vessel hull 100. It is noted that the clamping pad 115 here has the form of a shallow recess cut into the plate-shaped member 241 which is fixed to the flange portion 24 and the flange plate portion 26.

Furthermore, FIG. 3 shows a guide surface 113 which is inclined outwardly with increasing height of the hoisting chamber. The guide surface 113 cooperates with the clamp 114 of the clamping means 11. With the cylinder bolt 117 the hydraulic cylinder 111 is fixed to the hoisting chamber wall, so that the cylinder 111 can pivot around this cylinder bolt 117. Further, an urging means 116 is provided, which urges the cylinder 111 of the clamping means 11 towards the outside of the hoisting chamber so as to ensure that the clamp 114 is always guided by the guide surface 113.

Now starting out from the position of the cylinder 111 shown in dotted lines in FIG. 3, in which the cylinder 111 extends almost parallel to the hoisting chamber wall and the rod 112 is retracted into the cylinder, functions of the clamping means are described. When the flange portion 24 is to be clamped for holding it (and the unit 2) in its mounted position, the hydraulic cylinder 112 is controlled so as to extend the rod 112. The clamp 114 moves guided by the guide surface 113 towards the clamping pad 115, which guided movement is supported by a guide shoe 118 provided close to the clamp 114 and cooperating with the guide surface 113. Once the cylinder 111 has fully extended its rod 112, the clamp 114 sits into the shallow recess 115 as the clamping pad provided on the flange portion 24, i.e. on the plate-shaped member 241 thereof. The hydraulic cylinders 111 are strong enough to securely clamp the unit into its mounted position, so that the position of the unit in regard to the opening in the vessel hull can be securely held or maintained while the fixing means 14 are screwed off. In order to securely avoid that any unintentional release of the clamping of the flange portion 24 may happen, it is suggested that the cylinders 111 are provided with locking valves which cut off the fluid connection of the hydraulic cylinder to the hydraulic system in order to maintain the cylinder in its actual position.

Once the fixing means 14 have been removed and the hoist means (not shown) is fixed to the lifting eyes 25 (FIG. 2), the clamping may be gradually released. In particular, looking at FIG. 3, the cylinder 111 is controlled so as to slowly retract the rod 112. Because the fixing means 14 have been removed, and due to the differential pressure between inside the hoisting chamber 1 and the water pressure at the bottom of the vessel 100, the flange portion 24 will move upward following the cylinder rods 112 movement while keeping the engagement between the shallow recess 115 and the clamp 114. Once the seal 13 lifts up from its counter surface, water rapidly flows into the hoisting chamber 1. After the hoisting chamber is flooded to a required level, the cylinder 111 is controlled to further retract the rod 112. When the pressure differences and forces have been leveled out, the unit 24 following its own weight will again sit on the seal 13 with its flange plate portion 26.

Once the cylinders have been retracted, following the urging force of the urging means 116, each cylinder 111 will again lie flat or substantially flat against the hoisting chamber wall. The unit 2 may then be lifted to be taken out of the hoisting chamber.

When installing the unit again in its mounted position, the unit will be lowered until the flange plate portion 26 properly sits on seal 13. It is noted that the guide rails 12 provided in the hoisting chamber securely guide the lowering unit into this position. Then, cylinder 111 is controlled to extend the rod 112 and, guided by the guide surface 113, the clamp 14 will move into engagement with the shallow recess 115 on the flange portion 24. This happens while the hoisting chamber is filled with water. When the clamping means have clamped the unit 2 into the mounted position, water can be pumped out of the hoisting chamber so as to dry the working space there. It is noted that the cylinders of clamping means are also maintained in a locked state, for safety reasons.

Once the water has been pumped off, persons for re-applying the fixing means 14 may climb down the hoisting chamber to set the screws. After the screws have been set and fixed, the clamping means can be retracted by retracting the rod 112 into the cylinder 111. This is recommended, because the cylinder rod 112 is then protected against corrosion when it is located in the cylinder 111.

Figure 4:
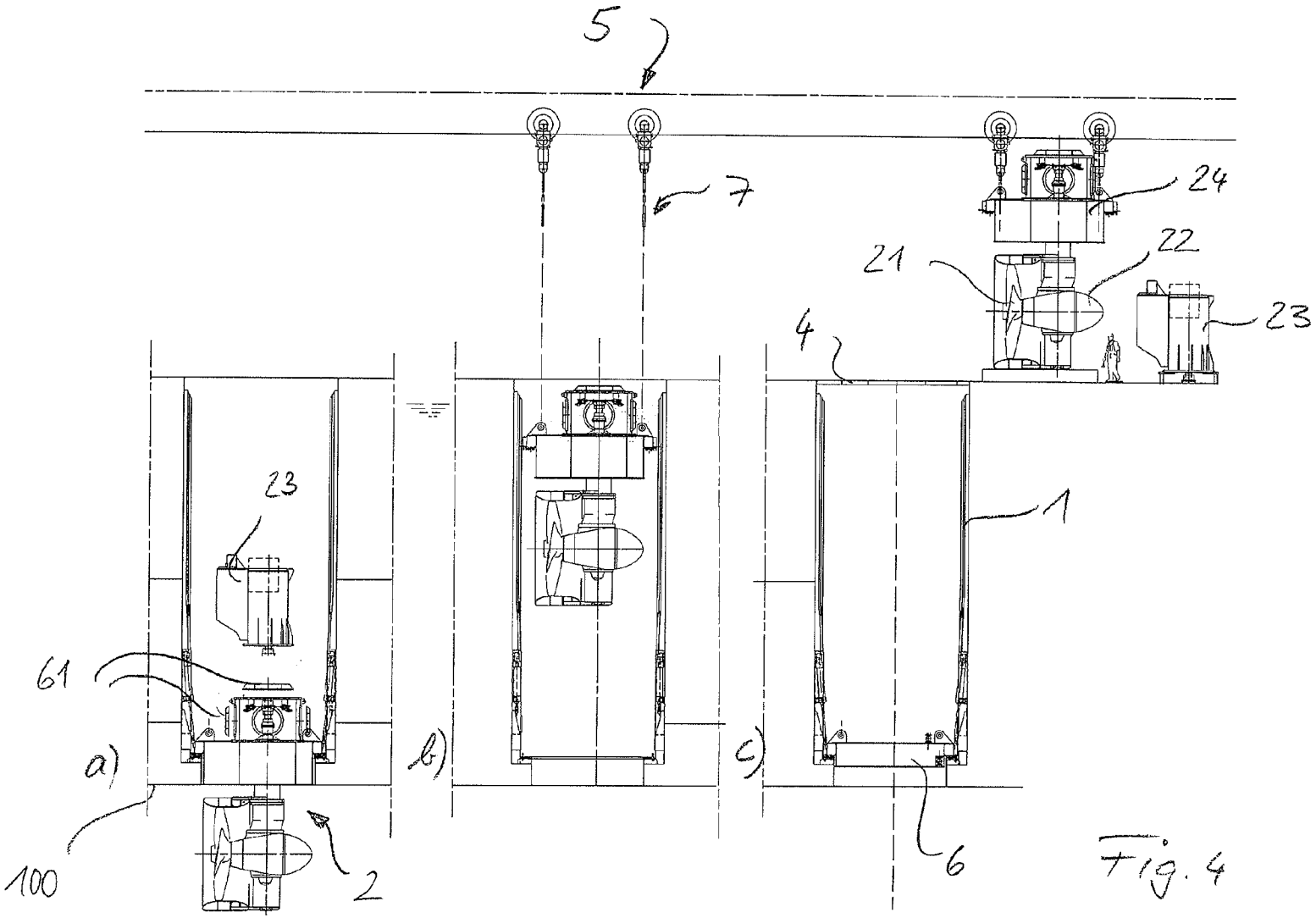
FIG. 4 shows the sequence of dismounting a thruster unit from a vessel hull.

Finally, FIG. 4 shows a sequence of steps a), b), c) in which a unit in the form of a thruster 2 is dismounted from a vessel hull 100. On the left in FIG. 4, a step a) is shown in which the electric drive motor 23 is removed from the thruster 2. After removal of the electric motor 23, drive connection covers 61 are mounted to the thruster 2 to close all openings against the immersion of water when the hoisting chamber 1 is to be flooded. The drive connection of the thruster 2 usually consists of a flexible coupling; it may however also or additionally include a gear box. Also, a hoist means 7 is already fixed to the flange portion 24 of the thruster 2 as is indicated at the right lifting eye in step a) of FIG. 4. Further, the clamping means are activated so as to clamp the flange portion 24 against its seat in the vessel hull 100. Once the clamping is set, the fixing means (screws) can be removed and the persons leave the hoisting chamber.

Then, the clamping means is gradually released so as to let water flow into the hoisting chamber. Once the hoisting chamber is filled to the required water level, the clamping means can be released, that is, as described under reference to FIG. 3, the rods of the cylinders are retracted.

Then, continuing to step b) in the middle of FIG. 4, it is shown that the hoist means 7 of a crane 5 are used to pull up the thruster 2 by lifting it at the lifting eyes. During lifting, the thruster 2 is guided in the hoisting chamber by means of the guide rails which are indicated with several parallel lines on the chamber walls in step b) of FIG. 4.

When the thruster 2 is completely withdrawn from the hoisting chamber 1, the status of step c) in FIG. 4 will be established in that a provisional cover or lid 6 is inserted into the hoist chamber so as to close the opening in the vessel hull using the flange seat at the bottom of the chamber. It is noted that clamping with the clamping means is possible because the lid 6 has the same clamping pads as are provided with the flange portion 24 of the thruster 2. Depending on how long the hoisting chamber has to stay closed, the lid may be additionally fixed with fixing means after the water has been removed from the chamber. Basically, however, it should be sufficient to press the lid down by a clamping means. Also, an additional cover 4 is put on the top of the hoisting chamber for safety reasons as discussed above.

In FIG. 4, dismounting the thruster and putting it on deck of the vessel has been described. Mounting of the thruster after maintenance or for replacement is done in the opposite order of steps. That is: removing cover 4, clamping lid 6, fixing hoist means 7 to lid 6, removing any fixing means (if any), and gradually releasing the clamping force so as to flood the hoisting chamber 1. Once the required water level is reached in hoisting chamber 1, lid 6 is lifted after clamping has been released. The lid 6 is removed from hoisting chamber 6.

Then, proceeding back to step b), the thruster 2 fixed to the hoist means 7 will be led down the hoisting chamber 1 while being guided by the guide rails 12. Once the thruster 2 is set in its mounting position, clamping means 111, 112, 114, 115 are activated to press the flange portion 24, 26 of the thruster 2 against its seat to seal the bottom of the hoisting chamber 1. The hoisting chamber 1 is then pumped empty and in the dry space fixing means like screws are set and fixed. After that, clamping may be released. Hoist means 7 are separated from the lifting eyes of the thruster and covers 61 are removed. Thereafter, the electric motor 23 can be lowered into position and fixed for operation. After connection work has been done, the thruster 2 is ready for use again.

In the above example, the invention has been described using a thruster as the unit which passes through the vessel hull. However, it may be any, in particular large, unit of any vessel or ship for the maintenance of which the invention may be applied. In particular, these units can be oil or gas well connectors, drilling equipment, pumping equipment, etc. Due to the clamping provided to hold the unit in sealing contact with its sealing seat, and having an automatic engagement of the clamping means provided, it can be achieved that no person has to enter a water-filled hoisting chamber, that is, all steps can be carried out in dry environment without diving work. Of course, modifications can be seen in using divers for setting the clamping means or other work.

What is claimed is:

1. A method for maintenance of a unit arranged in a watertight hoisting chamber and closing an opening in a vessel hull, wherein the unit is adapted to extend into the water below the vessel, the method comprising the steps of:

clamping the unit in its mounted position by clamping means, releasing fixing means fixing the unit into its mounted position while holding the unit clamped in position, at least partly flooding the hoisting chamber, releasing the clamping of the unit only once the hoisting chamber has been flooded to a required level, and hoisting the unit away from its mounted position.

2. The method according to claim 1, further comprising the step of:

lowering the unit into its mounted position inside the hoisting chamber, clamping the unit in its mounted position closing the opening in the vessel hull, at least partly removing the water from the hoisting chamber, applying fixing means fixing the unit in its mounted position, and releasing the clamping of the unit.

3. The method according to claim 1, further comprising the step of:

placing a hoisting chamber assembly with an open upper end over the unit, so as to arrange the unit requiring maintenance therein, and fixing the chamber assembly to the vessel hull in a watertight manner with respect to the hull, wherein the open upper end of the chamber extends above the water level.

4. The method according to claim 1, wherein the step of flooding the hoisting chamber comprises the step of gradually releasing the clamping means clamping the unit into the mounted position until water enters through the opening of the hull.

5. The method according to claim 1, further comprising the step of fixing a hoist means to the unit before flooding the hoisting chamber.

6. The method according to claim 1, wherein the clamping of the unit uses hydraulic forces.

7. The method according to claim 1, wherein the unit is a thruster assembly having a drive motor and a propeller, and wherein the drive motor of the thruster assembly is removed and a temporary watertight flange is installed onto the drive motor installation before flooding the hoisting chamber.

* * * * *